US008983282B2

(12) United States Patent
Bishara

(10) Patent No.: US 8,983,282 B2
(45) Date of Patent: Mar. 17, 2015

(54) ELECTRIC HEATER FOR HOOKAH

(71) Applicant: Edwar Bishara, Pasadena, CA (US)

(72) Inventor: Edwar Bishara, Pasadena, CA (US)

( * ) Notice: Subject to any disclaimer, the term of this patent is extended or adjusted under 35 U.S.C. 154(b) by 110 days.

(21) Appl. No.: 13/790,261

(22) Filed: Mar. 8, 2013

(65) Prior Publication Data

US 2014/0255014 A1 Sep. 11, 2014

(51) Int. Cl.

| | |
|---|---|
| ***F24H 1/10*** | (2006.01) |
| ***A24F 1/14*** | (2006.01) |
| ***F24H 3/00*** | (2006.01) |
| ***A24F 1/30*** | (2006.01) |

(52) U.S. Cl.
CPC . *F24H 3/002* (2013.01); *A24F 1/30* (2013.01)
USPC ..... 392/488; 131/173

(58) Field of Classification Search
None
See application file for complete search history.

(56) References Cited

U.S. PATENT DOCUMENTS

| | | | | |
|---|---|---|---|---|
| 3,918,464 | A * | 11/1975 | Kolodziej | 131/173 |
| 5,993,748 | A * | 11/1999 | Wheeler | 131/173 |
| 8,550,091 | B2 * | 10/2013 | Yomtov et al. | 131/328 |
| 2010/0126516 | A1 * | 5/2010 | Yomtov et al. | 131/173 |
| 2010/0212678 | A1 * | 8/2010 | Bishara | 131/173 |
| 2010/0212679 | A1 * | 8/2010 | Bishara | 131/173 |
| 2014/0069446 | A1 * | 3/2014 | Haddad | 131/329 |

* cited by examiner

*Primary Examiner* — Thor Campbell
(74) *Attorney, Agent, or Firm* — KC Bean, Esq.

(57) ABSTRACT

Electric heat for generating smoke from tobacco or the like in a hookah type smoking pipe. Electric heat is obtained from an electrically powered heating element which may be placed proximate the tobacco. The heating element may be contained within a housing which in turn may be placed above the smoking chamber of the hookah. The housing may have adjustably damped holes disposed to pass air over the heating element. Electrical circuitry serving the heating element may comprise a step down transformer and a voltage adjusting switch. The heating element may be integral with the hookah, may take the form of a separate component which is mountable over the smoking chamber of the hookah, or may comprise a free standing assembly which may be placed to stand adjacent to the hookah.

15 Claims, 8 Drawing Sheets

ELECTRIC HEATER FOR HOOKAH

CROSS-REFERENCE TO RELATED APPLICATION

This application is a Continuation-in-Part of U.S. Non-Provisional application Ser. No. 12/431,955, which is a Continuation-in-Part of Non-Provisional application Ser. No. 12/393,286 filed Feb. 26, 2009, and claims the benefit of priority thereto.

FIELD OF THE INVENTION

The present invention relates to water pipes for smoking combusted materials, of the type known as hookahs, and more particularly to an electric heating source for hookah type smoking pipes.

BACKGROUND OF THE INVENTION

Hookah water pipes have long been used in smoking combusted materials such as tobacco. As traditionally practiced, a hookah provides a water receptacle having an inlet conduit and at least one and often several outlet conduits. Smoke enters the water receptacle through the inlet conduit and is distributed to individual smokers through the outlet conduits, which are typically connected to hoses. Smoke is generated in a bowl in which a combustible substance such as tobacco is placed. A heat source is placed over the tobacco. In traditional practice, ignited charcoal is used as the heat source. The bowl is loaded with tobacco then covered in a small piece of perforated aluminum foil or a glass or metal screen. Lit coals are placed on top of the bowl containing tobacco. The hot air, heated by the charcoal ignites the tobacco, thus producing smoke vapor, which is passed down through the inlet conduit into the water receptacle.

Heating the tobacco generates smoke, which when one inhales through the outlet conduit, is drawn into the water receptacle through a supply conduit. The supply conduit is arranged to terminate below the level of the water within the water receptacle to assure filtration of raw smoke obtained from the bowl. The act of breathing air from the head space of the water receptacle induces partial vacuum in the head space, which in turn draws in smoke from the bowl through the supply conduit.

This arrangement requires that a fuel such as charcoal be provided and suitably ignited. This heat source must be maintained during smoking so that the combustible material is suitably ignited. With the use of lit charcoal, it is possible for products of combustion, such as volatile gasses and ash to be conducted into the water receptacle along with the smoke.

It is difficult at best to regulate the output of a combustion based heat source. The heat generated by ignited charcoal is not ideal because the heat generated is not constant or evenly distributed across the tobacco. Additionally the charcoal dissipates relatively quickly, requiring the addition of more charcoal to maintain proper combustion temperatures. Constant handling of ignited charcoal is an inconvenience to user and poses material risks of burn injury. Further, using ignited charcoal is not preferable as it will release unwanted carbon based compound into the smoke vapors, potentially fouling the flavor of the tobacco or releasing toxins that could cause harm the user. Such smoke and other products of combustion may be objectionable within a closed room or building.

Uses of electric heating sources have been proposed to overcome some of these limitations. U.S. Pat. No. 5,993,748 to Wheeler and U.S. Patent Appl. No. US2006/0086365 to Liu presents two such examples. Although an improvement over ignited combustible heat sources, there remain issues with electric heat sources for use with hookah type water pipes.

Heater construction material, air flow and distance of the heat source from the tobacco will directly impact the burn rate and vapor quality of tobacco when smoked in a hookah type water pipe. If the heat generated is too high or too close to the tobacco, the temperature will be too high and the ignition rate of the tobacco will be too fast, unnecessarily burning more tobacco than is desirable. If the heat generated is too low or the distance of the heat source too removed, the tobacco will not maintain ignition and the tobacco will be extinguished during idle periods. These considerations affect the smoke quality and the experience of the user.

The materials used for the construction of the heater are an important consideration. Many metals will react with air when heated, generating metal oxides or other compounds that can be harmful to the user. For example, when using copper as a material for an electric heater, copper (II) oxide can be generated by heating metallic copper in air. Copper (II) oxide is an irritant that can cause damage to the endocrine and central nervous system. Contact to the eyes or skin can cause irritation. Ingesting copper oxide is known to result in a continuous metallic taste, nausea, vomiting and stomach pain. Inhalation of fumes of cupric oxide can lead to damage to the lungs, septum and a disease called metal fume fever, which can result in flu like symptoms. Therefore a need exists to build an electric heater from materials that eliminate dissemination of toxins during use.

Different materials will also impact heat generation and heat transfer at the interface of the heat source and tobacco, which is critical to prevent unnecessary burning of tobacco both in terms of rate of burn during smoking and burn rate during idle periods of use. Control of heat output with electric heat sources is very difficult. Ideally, it is preferred to maintain the temperature below 800 degrees Fahrenheit. Above this temperature oxidation is common. Some substances have a high thermal conductivity and will readily transfer heat without distorting the form or shape of the heat transfer substance. Other materials have insulating properties that limit heat generation and heat transfer. Copper has a high thermal conductivity, but may have reactions with air that cause toxic vapors to be released. Therefore a need exist for an electric heater for used with hookah type water pipes that uses materials that adequately generate and transfer heat without reacting to release harmful vapors.

Air flow is also an important aspect to the proper burn of tobacco in a hookah type water pipe. Know electric heating systems do not control air flow and simply open air pathways that provide for free air flow rather than restricted or directed air as it is drawn into the bowl and flows across the heater. Free air flow tends to provide cooler air that in turn cools the interface between the heat source and tobacco. This requires higher temperature from the heater to maintain tobacco ignition. With higher temperatures and free air flow, tobacco is burned at a significantly faster rate when active and more energy is required to maintain the temperature. Therefore, a need exists for an electric heater with a managed air flow without increasing heat that optimized the burn rate of tobacco.

The distance between the heat source and the tobacco also impact the burn rate and quality of tobacco vapors. If a high temperature electric heater is placed at a significant distance from the tobacco it may still ignite the tobacco, but the heater may be at a temperature that may be dangerously hot and not suitable for the environment in which it is being used. Conversely, a lower temperature electric heater may be place directly on the tobacco to produce vapors. However, a low temperature heater would be inconvenient and require constant monitoring and reigniting of the tobacco. Additionally, an improperly distanced heater would inhibit proper air flow effecting the proper burn of the tobacco. Therefore a need exists for an electric heater for a hookah type water pipe that combines proper materials, air flow control and distance between the heat source and the tobacco to properly ignite tobacco.

SUMMARY OF THE INVENTION

The present invention replaces combustion of fuel as the heat source in a hookah type water pipe in favor of an electric heat source. The electric heater may take any one of several forms. In one form, the electric heater may be removably placed on, in or near the bowl or otherwise suspended from or supported on the hookah. A second form is to make the electric heater integral with the bowl or other part of the hookah. A third form is to provide the electric heater as a free standing assembly, which is separate from the hookah, although operably disposed to heat a combustible such as tobacco and allow for smoke to be conducted from the heated combustible to the water receptacle of the hookah.

The electric supply may be any standard 110 or 220 volt outlet and controlled such that the wattage consumed is variable. Wattage control of the electric power source may be an optional manual dial or microcontroller based system that monitors wattage and maintains it in a preselected range. Optionally, a thermostatic control may be provided to control wattage and heat output. In another option, a manual variable switch may be used to control wattage and heat output. In yet another option, and tilt sensor may be employed to monitor the position of the heater and automatically shut off the power if it is determined to have tipped.

The heating element may comprise an exposed resistive element, or may comprise a covered resistive element.

Another means for heating control is regulation of air flowing past the heat source to tobacco or the like which is to be smoked. Regardless of the nature of the power supply and its controller, the electric heater may have a damper to control air flow through holes formed in the top or bottom of the heater and holes formed in the side of the heater. Air flow may also be managed by placement of vents or holes in the heater housing that allow for directed air flow and the regulation of the volume of air flow.

It is an object of the current invention to eliminate burning a combustible fuel in a hookah as a heat source for roasting a combustible material such as tobacco.

Another object of the invention is to utilize electrical power at inherently safe voltages.

A further object of the invention is to control the amount of heated air which is produced by an electric heater.

It is yet another object of the invention to eliminate the release of toxins created by the oxidation of metals during heating.

Still another object of the invention is to regulate air flow through the heater.

It is an object of the invention to provide improved materials and composition elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
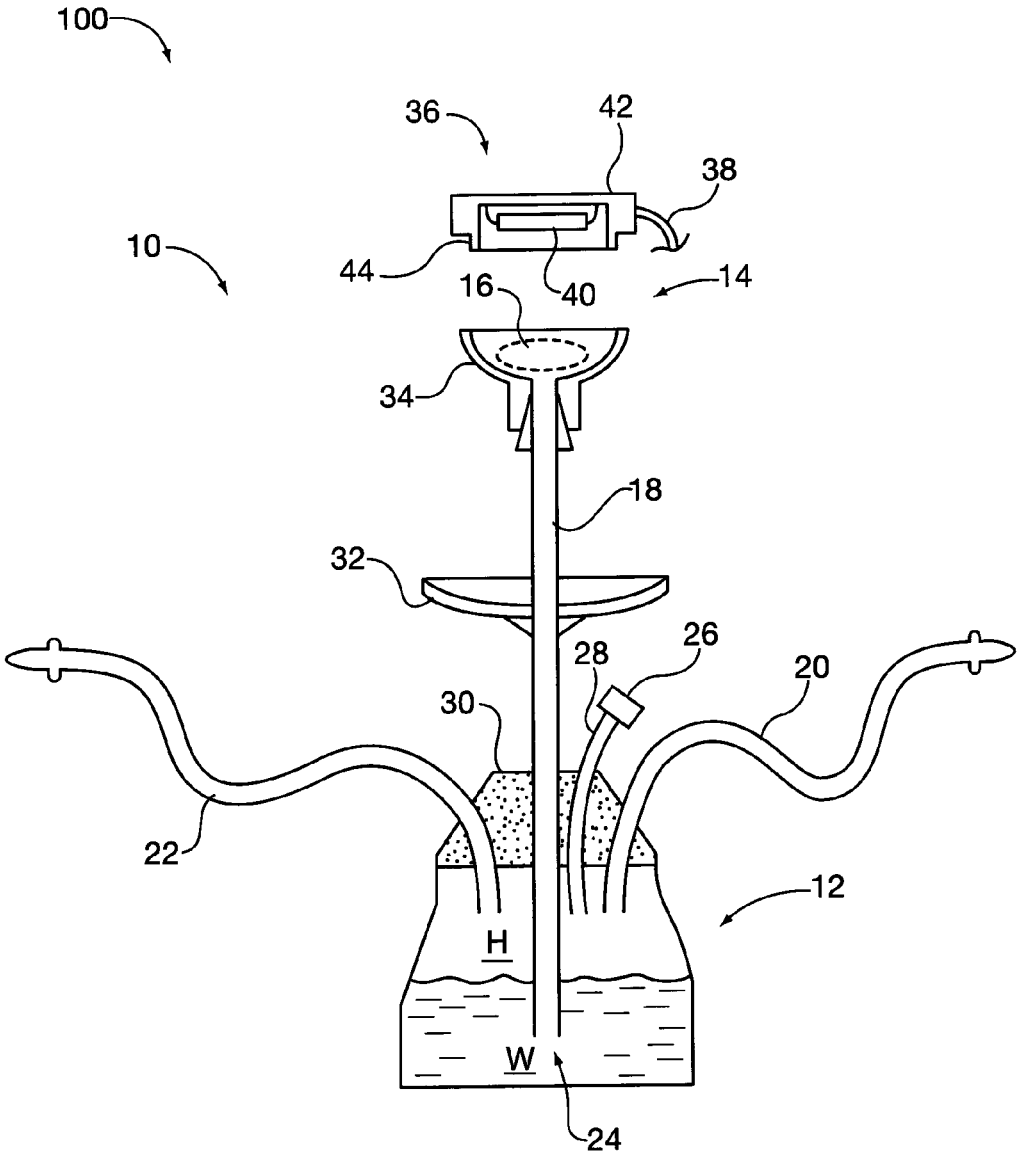
FIG. 1 is a side view of a hookah using an electrical heat source for generating smoke according to at least one aspect of the invention.

FIG. 1 shows a simplified hookah type water pipe 100 having an electrical heat source for igniting combustible substances such as tobacco or other smoking material to generate smoke. The hookah type water pipe 100 may comprise a conventional hookah 10 which comprises a liquid chamber 12, a smoking chamber 14 for receiving a combustible substance such as tobacco 16 and for generating smoke (not shown) by subjecting the tobacco 16 to heat. As employed herein, the term "chamber" will be understood to encompass both an enclosed or unenclosed space for performing a specified function and also surrounding structure such as walls, floor, etc., as may be necessary to define and maintain structural integrity of the space.

In conventional hookahs, heat is generated by placing charcoal (not shown) above or within the smoking chamber 14. The charcoal may be contained in a partially open cage (not shown) which is placed on the tobacco 16 or otherwise in heat exchange relation thereto. The charcoal is ignited. Heat from the burning charcoal is exposed and transferred to the tobacco 16. The tobacco 16 is partially combusted, thereby generating smoke.

As employed herein, the term "heat exchange relation" will be understood to define any location in which an electric heater may expose a combustible substance to enough heat that the combustible substance partially combusts, thereby generating smoke (for example, in direct contact with, separated by a barrier, above, or below the combustible substance)

Smoke is drawn through a smoke supply conduit 18 disposed to conduct gasses and smoke from the smoking chamber 14 to the liquid chamber 12. Smoke is discharged into the liquid chamber by partial vacuum induced when a person (not shown) using the hookah 10 inhales through a smoking conduit 20 disposed to conduct cooled gasses and smoke from the smoking chamber 12 to the person smoking using the hookah 10. A hookah such as the hookah 10 may have more than one smoking conduit 20, including for example the smoking conduit 22. This enables the hookah 10 to be used for smoking simultaneously by more than one person. The smoking conduits 20, 22 may comprise flexible hoses.

It will be seen in FIG. 1 that the liquid chamber 12 is partially filled with water W. The water W is sufficient in volume to cover the lower open end 24 of the smoke supply conduit 18. When a person inhales through a smoking conduit 20 or 22, a partial vacuum is induced in the headspace H of the liquid chamber 12. Smoke and gasses such as air drawn from the smoking chamber 14 pass through the water W and are cooled thereby prior to passing to the headspace H. Inhalation through the smoking conduit continues until the person inhales cooled smoke from the headspace H. Vacuum levels within the liquid chamber 12 may be moderated by an air valve 26 which incorporates a check valve (not separately shown) adapted to allow air to pass from the exterior of the hookah 10 to the headspace H. The unidirectional nature of the check valve prevents smoke and gasses from exiting the liquid chamber 12 through the air valve 26.

The smoking conduits 20, 22, the conduit 28 serving the air valve 26, and the smoke supply conduit 18 pass through a gasket 30 which is arranged to close the top of the liquid chamber 12 and to pass the smoke supply conduit 17, the conduit 28, and each one of the smoking conduits 20, 22 from the liquid chamber 12 to the exterior thereof while sealing the smoking chamber 12 against loss of smoke residing therein.

In a traditional hookah such as the hookah 10, a plate 32 projects or radiates outwardly from the smoke supply conduit 18 between the smoking chamber 14 and the gasket 30. Also in a traditional hookah such as the hookah 10, the tobacco 16 is contained in a bowl 34, which bowl 34 may serve as the lower portion of the smoking chamber 14. The upper portion of the smoking chamber 14 may have a covering member (not shown), may comprise the previously mentioned cage for containing burning charcoal, or may be open to the atmosphere.

It should be noted at this point that orientational terms such as upper and lower refer to the orientations depicted in the referenced drawing figures. In turn, the drawing figures depict their subject matter in orientations of normal use, such as supported on a horizontal tabletop or desktop. Therefore, orientational terms must be understood to provide semantic basis for purposes of description, and do not limit the invention or its component parts in any particular way.

To further characterize conventional configuration of traditional combustion based hookahs, when the hookah type water pipe 100 is in an operable position resting on a generally horizontal supporting environmental surface, as shown in FIG. 1, the liquid chamber 12 is the lowermost component and the smoking chamber 14 is located above the liquid chamber 12 in vertical registry therewith. Also, the liquid chamber, 12, the gasket 30, the smoke supply conduit 18, and the smoking chamber 14 are generally coaxial and disposed in vertical registry with one another.

An electric heater 36 may be disposed in heat exchange relation to the smoking chamber 14. The electric heater 36 may comprise an electric supply circuit (not shown in its entirety, but seen in the view of FIG. 1 to include an electrical supply conductor 38 and an electrical resistive heating element 40 which is connected to the supply conductor 38). As employed herein, the terms "circuit" and "circuitry" will be understood by one skilled in the art to encompass all conductors, components, and connections necessary to accomplish the described functions regardless of whether all such conductors, components, and connections are explicitly shown or described. Similarly, conductors shown or described in the singular will be understood to comprise more than one conductor where necessary to make function operational.

The electric supply circuit may be disposed to obtain electrical power at a first voltage and to supply electrical power to the resistive heating element 40 at a second reduced voltage, as will be further explained hereinafter.

The electric heater 36 may comprise a support element which holds the heating element 40 at a predetermined constant orientation relative to the smoking chamber 14 when the user is smoking, and a mounting element disposed to mount the support element and the heating element 40 to the smoking chamber 14. The mounting element may enable manual removal of the support element and the heating element 40 from the smoking chamber.

In FIG. 1, the support element may be that part of the housing 42 which grips the heating element 40. The mounting element may be that part of the housing 42 comprising a depending skirt 44 which, when the electric heater 36 is lowered into engagement with the bowl 34, is retained by gravity or by friction or by both.

Figure 2:
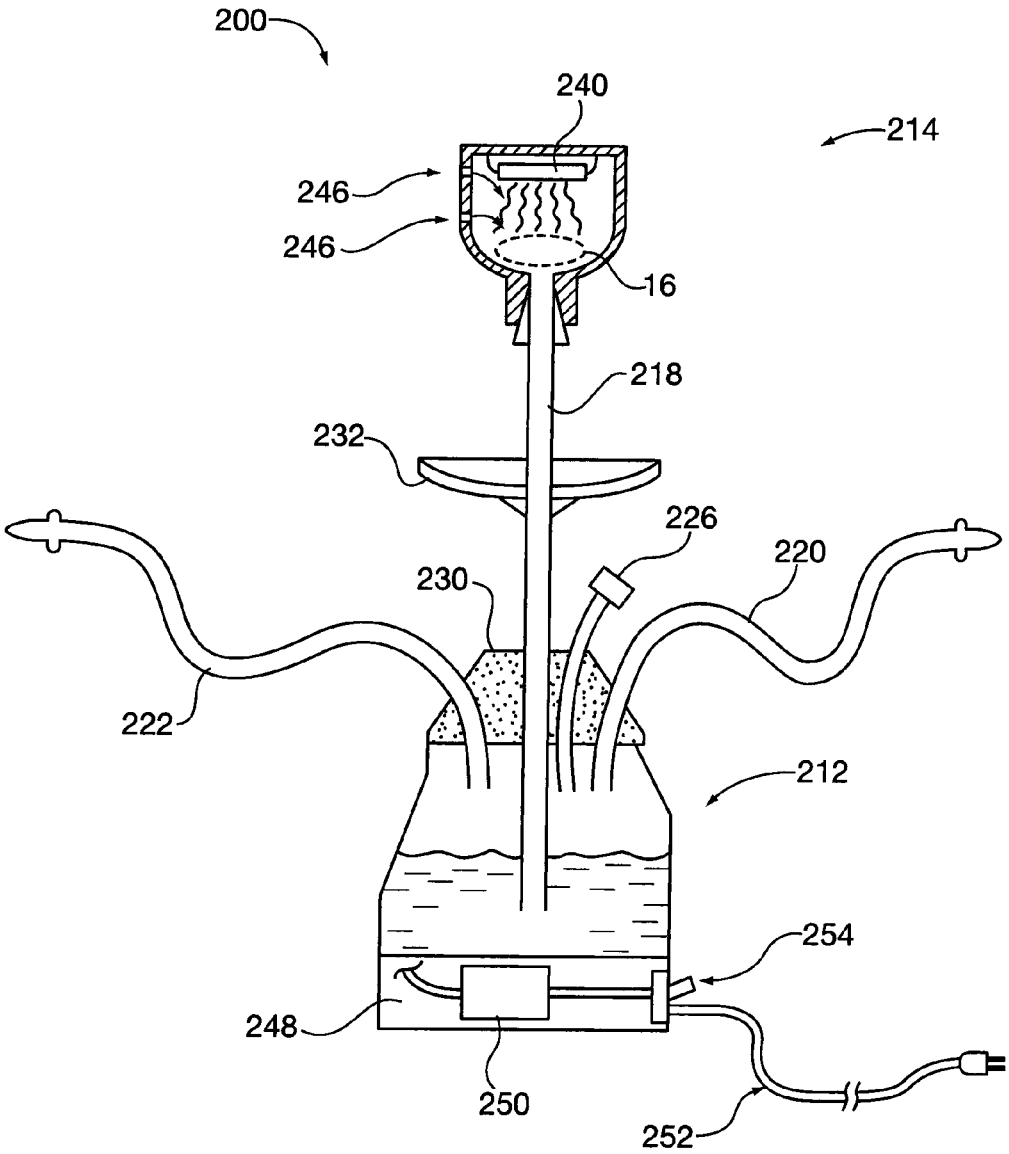
FIG. 2 is a side view of a hookah using an electrical heat source according to at least a second aspect of the invention.

FIG. 2 shows a hookah type water pipe 200 wherein structure corresponding to the electric heater 36 is integral with the smoking chamber 214. The smoking chamber 214 may be the structural and functional equivalent of the smoking chamber 14 of FIG. 1. The same holds true for smoking conduits 220, 222, an air valve 226, and a gasket 230.

The smoking chamber 214 provides a place to hold a combustible substance such as tobacco 16. A drawer or slot (not show) may be integral with the smoking chamber 214 to allow access to the interior for easy placement of the tobacco 16. An electric heating element 240 is held to the upper wall of the smoking chamber 214 such that heat radiated therefrom ignites the tobacco 16. The side wall of the smoking chamber 214 preferably has openings 246 for passage of air into the smoking chamber 214. Air flow is preferably greater from the top through openings above the heating element 240 and more restricted than air flow from opening on the side wall 246.

The hookah type water pipe 200 may comprise a base comprising an electrical chamber 248 for containing a voltage adjuster such as a step down transformer 250 and a plug and cord assembly 252 which is connected to the transformer 250 and which projects from the electrical chamber 248 so as to reach a standard 120 volt or for European countries 240 volt electrical receptacle (not shown) of a building (not shown). The circuitry which connects the plug and cord assembly 252 to the electric heating element 240, not shown in its entirety, thereby supplies electrical power to the electrical heating element 240 at reduced power from the 120 volt source. The circuitry may include a switch 254 and a tilt sensor (not shown). The tilt sensor will monitor the position of the hookah and automatically switch off the power circuit it the orientation of the hookah is not normal from the table which the hookah rests.

Voltage reduced from that of conventional 120 volts may be derived not only by use of the transformer 250. For example, a hookah such as the hookah 200 may comprise instead a conventional battery charger (not shown) which in addition to rectifying household AC power to DC power, also reduces the voltage. Reduced voltage may be obtained by incorporating a voltage divider (not shown) into the circuitry, by introducing resistors (not shown) into the circuitry, or in any other suitable well know way.

Figure 3:
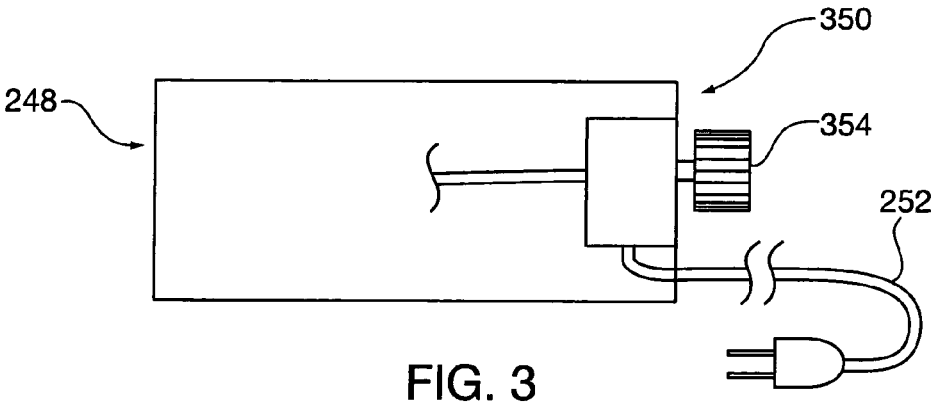
FIG. 3 is an enlarged detail view of an alternative to the component seen at the top of FIG. 1.

Referring momentarily to FIG. 3, the voltage adjuster contained within the electrical chamber 248 may comprise a conventional dimming switch 350 which is adjusted by a dial operator 354.

Figure 4:
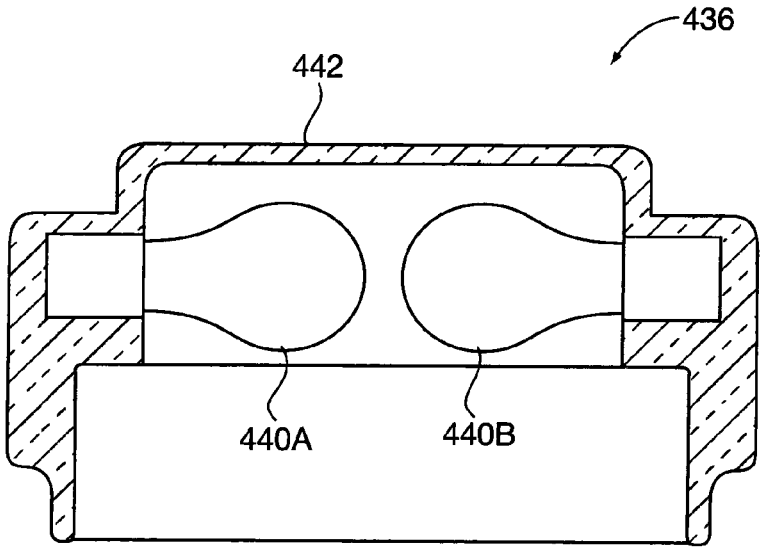
FIG. 4 is an enlarged detail view of an alternative to the component seen at the bottom of FIG. 2.

FIG. 4 shows an arrangement wherein a heating element may comprise one or more incandescent lamps 440A, 440B. Incandescent lamps 440A, 440B may be fabricated from materials which withstand fairly high temperatures, so that despite their usual usage as light sources, the incandescent lamps 440A, 440B may be employed as heat sources. The housing 442 of the heater 436 may be ceramic, glass or metal and may house those portions of electrical supply circuitry which is omitted from view in FIG. 4. The heater 436 may in other ways be the structural and functional equivalent of the heater 36 of FIG. 1, and is preferably constructed from a high grade ceramic.

Figure 5:
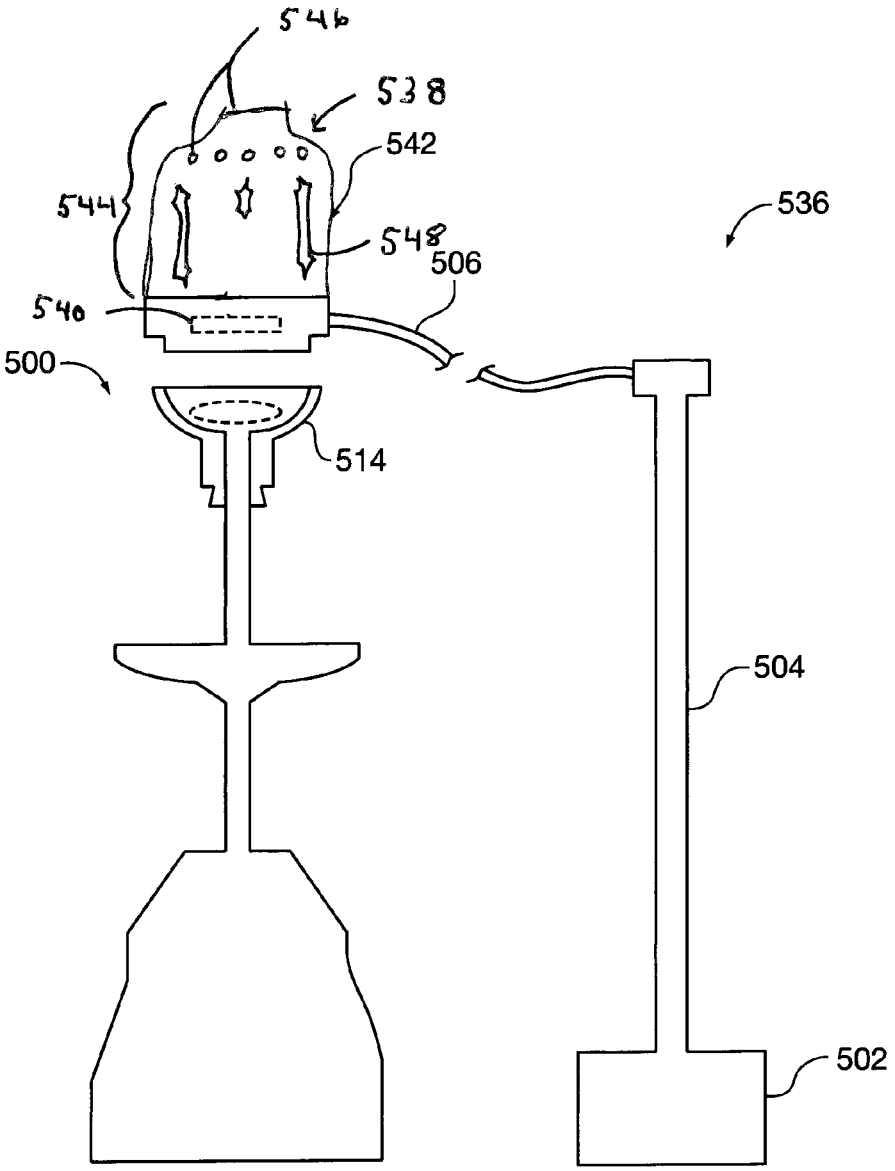
FIG. 5 is a side view of a hookah and a separate, free standing electric heater, according to a further aspect of the invention.

Turning now to FIG. 5, a hookah type water pipe arrangement includes a hookah 500 which may be for example similar to the hookah 10. The hookah 500 may be a free standing assembly which is served by an free standing electric heater 536 comprising a base 502, a rigid generally vertical post 504 disposed to project upwardly from the base 502 essentially a height of the hookah 500 when the base 502 is placed on a generally horizontal supporting environmental surface (not shown), and an electrical conductor 506 which projects from the vertical post 504 and extends to a heater head 538. The electrical conductor 506 may be flexible. The heater head 538 comprises a housing 542 which encloses a heating element 540 and extends above the heating element 540 where a volume 544 of space exists and air may collect.

The heater head 538 must be composed of a material that does not release toxins when heated. Most silica based glass and most ceramics can be used to manufacture the heater head 538. Metals may be used because they are malleable and easier to form into the header head components. Further, metals are highly conductive and allow for very good heat transfer properties. However, metal, as discussed above, can react with air at high temperatures generated by the heating element 540. Preferably, the heater head 538 is constructed of electro polished stainless steel 316L, but can be any metal core plated with nickel or gold. Alternatively, the heater head 538 is constructed of a copper core plated with nickel and then further coated with gold. This construction provides for good heat transfer without reacting to air.

The electrical conductor 506 is part of a circuit which is disposed to conduct electrical power to the heating element 540, and to enable the heater head to be placed over the smoking chamber 514 of the hookah 500 while the base 502 of the heater 536 rests on the generally horizontal supporting environmental surface beside the hookah 500. This is similar to how the heater 36 of FIG. 1 is placed over the smoking chamber 14 of its respective hookah 10. It will be seen that the electrical conductor 506 projects from the vertical post 504 at a height about equal to that of the smoking chamber 514, whereby length of the electrical conductor 506 is minimized while enabling operation when the hookah 500 and the electric heater 536 are placed on the same generally horizontal supporting environmental surface.

The housing 542 further includes a plurality of venting holes 546 on the upper portion of the housing 542 and a plurality of venting holes on the side walls 548 of the housing 542. The configuration of the upper holes 546 and the holes in the side walls 548 are critical to managing proper air flow within the housing 542 during the active air flow state and the idle no air flow state. The upper venting holes 546 are generally greater in number or size in comparison to the side wall venting holes 548 such that a stream of air flow is directed from the top of the housing downward through the volume of space past the heating element 540. The top down air flow creates a stream of air trigging the Bernoulli effect where the pressure along the perimeter of the air stream path is reduced relative to the air adjacent to the air stream path causing air to be drawn in through the side wall holes 548 and the volume of space in the upper housing 544, increasing the overall quantity of air flowing past the heating element 540. As is known, air expands as it is heated. The volume of space 544 allows for expansion of air as the air is drawn into the housing 542 and heated, without allowing the expanding heated air to escape the housing. The heated air can then be pulled past the heating element compounding the heat and providing for higher temperature to ignite the tobacco during the active state. This is desirable as it allows for greater tobacco ignition temperatures with less heat being generated from the heating element 540 directly. With a lower temperature heating element 540, during the idle period less heat is transferred to the housing.

The side wall holes 548 also provide for a means for air to escape the housing during the idle period. Without the side wall holes 548 heat is transferred to the housing 542 as air expands during idle, raising the temperature of the housing to undesirable levels, which in turn causes higher ignition temperatures and rapid burning of tobacco during the active use state. It is important to appreciate that the side wall holes 548 must be smaller in quantity or size than the top holes 546 so that the top to bottom air flow stream is maintained. The key purpose of the side holes 542 is to allow air to expand during the idle state.

Another important aspect of the housing 542 design of the current invention is that the diameter of the housing 542 be greater than the diameter of the hookah smoking chamber 514. Preferably the difference in the diameter is less than a quarter of an inch. The key benefit of this configuration is to allow cool air to backflow into the housing 542 from the bottom portion of the heater head 538 during the idle state. This assists in preventing heat transfer to the housing 538. In an embodiment shown in FIG. 9, air flow can be created by ports or holes through the walls of the upper member 860.

Figure 6:
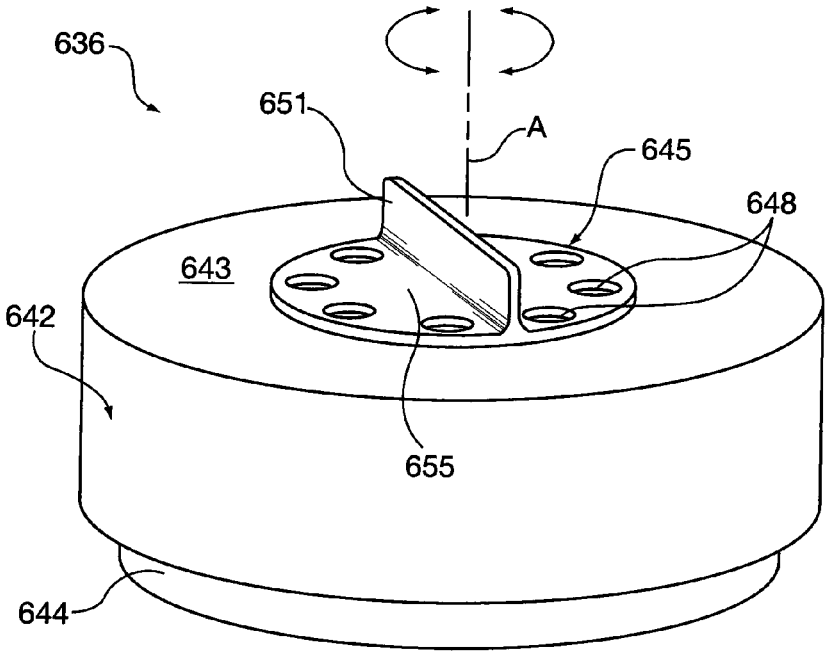
FIG. 6 is a perspective view of a heater which may be used with a hookah according to at least one aspect of the invention.
Figure 7:
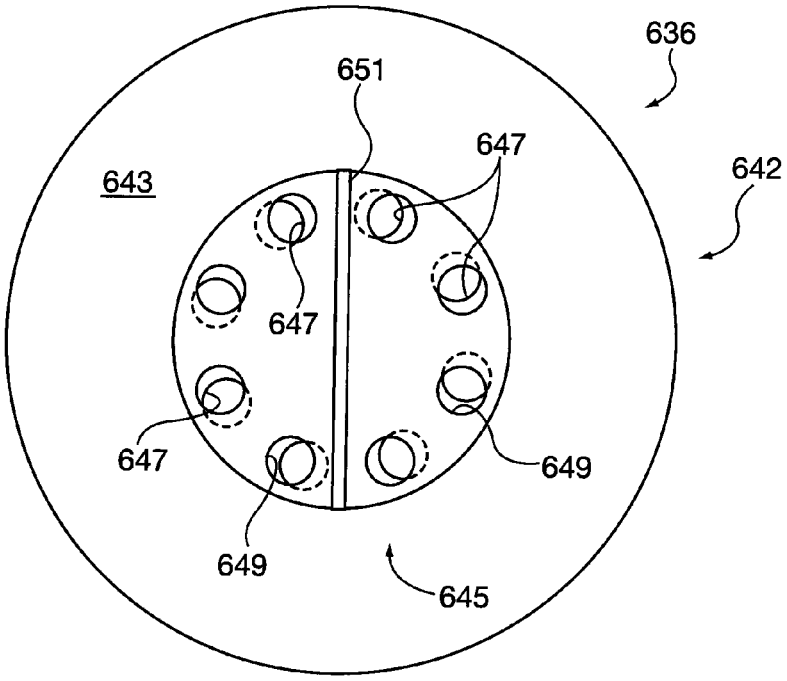
FIG. 7 is a top view of FIG. 6.

Referring now to FIGS. 6 and 7, a heater for a hookah type water pipe, such as the heater 36, may comprise a selectively variable damper arrangement disposed to regulate volume and direction of air flow over the heating element, such as the heating element 40. A heater head 636 may comprise a housing 644 (only the top edge of which is shown) and a housing cap 642 which further comprises a top wall 643 and a perforated closure 645 having a top wall 655. The housing 644 is analogous to the housing 542. The top wall 643 may have one or more openings 647 (concealed in FIG. 6, but shown in FIG. 7). The top wall 655 of the closure 645 may have corresponding openings 649. The closure is movably mounted on the top wall 643, being rotatable about an axis A in FIG. 6 when grasped and manipulated by a projecting handle 651. As the closure 645 is rotated, the openings 649 come into registry with and move out of registry with the openings 647 of the top wall 643. The openings 647 and 649 are disposed to communicate between the electrical heating element and the exterior of the housing cap 642, thereby enabling air to pass through the air gap and over the electrical heating element. This arrangement of adjustably positioned overlying openings selectively damps or throttles air flow into the heater 636 and over the heating element (not shown) by varying the effective area of the holes 647 and 649 which overlie one another. Of course, the holes 647 and 649 may be moved entirely out of registry to close the holes 647 and 649 to air flow.

The heater 636 may be similar to the heater 36 of FIG. 1, having supporting structure (not shown in FIGS. 6 and 7) and electrical circuitry serving the electric heating element (not shown in FIGS. 6 and 7). This circuitry may include any of the features of the circuitry described with respect to the previously presented drawing figures and their respective subject matter. The heating element may be partially covered with a perforated material or left uncovered at the bottom so that heat emanating from the heating element will heat combustible substances such as tobacco 16 which has been placed in the smoking chamber of the associated hookah, such as the hookah 10 of FIG. 1.

Figure 8:
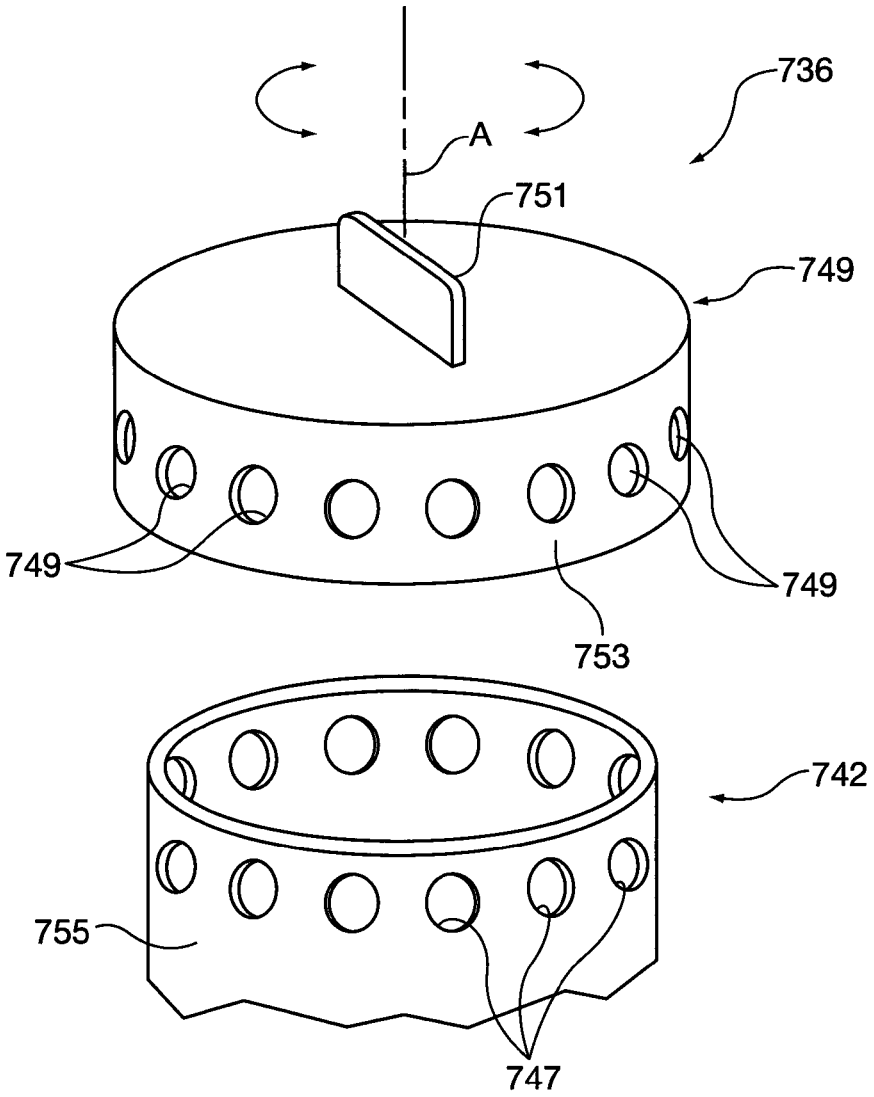
FIG. 8 is a perspective view of an alternative form of a heater such as the heater of FIG. 6.

FIG. 8 shows a heater 736 which is similar in function to the heater 636. However, in the heater 736, air passage openings 747 and 749 are formed on the respective side walls 755 and 753 of the heater housing 742 and the adjustable closure 745. The closure 745 may be rotatable about an axis A by grasping and manipulating a projecting handle 751.

A heater such as the heaters 636 and 736 may have air passage openings formed on both side walls such as the side walls 753 and 755 and also on the top walls such as the top walls 643 and 655 if desired.

Figure 9:
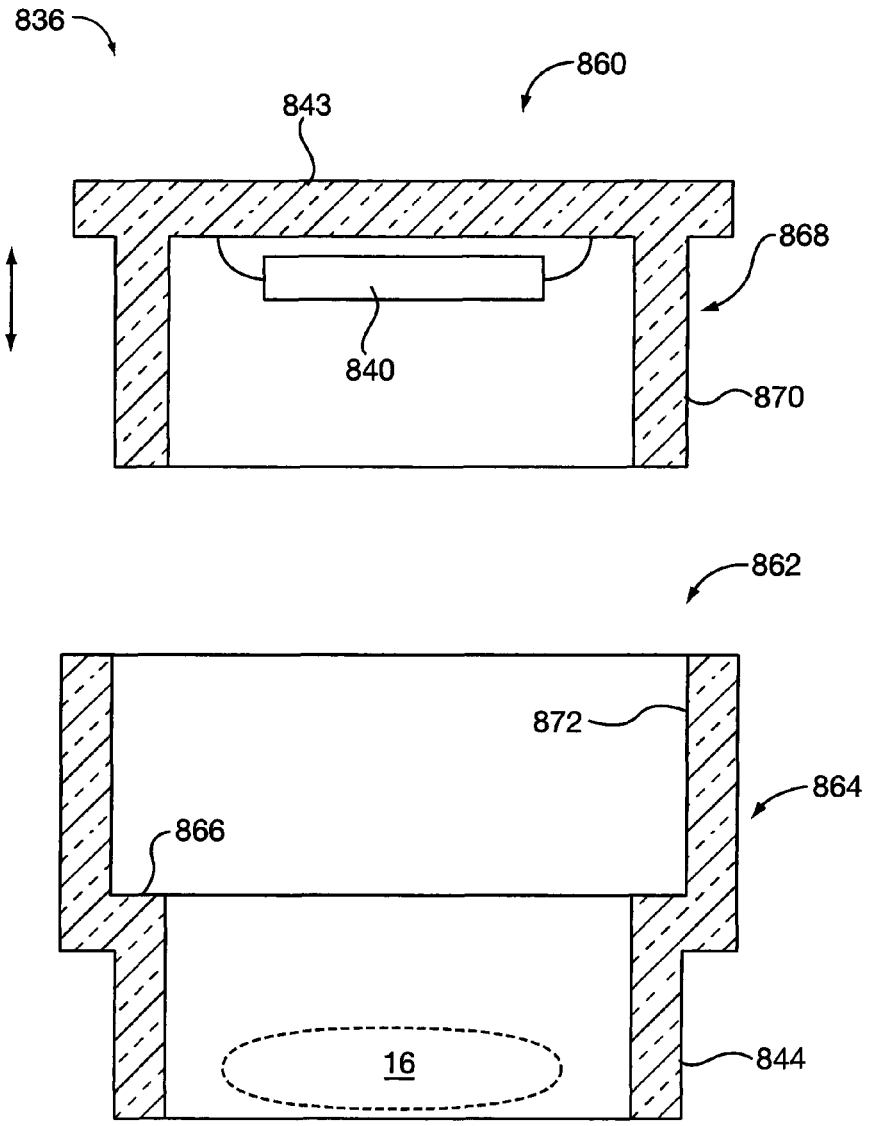
FIG. 9 is a side cross sectional view of another heater which may be used with a hookah according to at least one aspect of the invention.

FIG. 9 shows a heater position adjustment feature which may be introduced to a heater such as the heater 36. The heater adjustment feature may selectively vary proximity of the heating element from the floor of the smoking chamber, with the effect of varying proximity of a combustible substance such as tobacco 16 to the heating element of the heater.

A heater 836 may comprise an upper member 860 and a lower member 862 which slidably interfit. The lower member 862 may have a side wall 864 and a depending skirt 844. The depending skirt may be dimensioned and configured to cooperate with the bowl or smoking chamber of an associated hookah, such as the hookah 10 of FIG. 1. The lower member 862 may have a shoulder 866 which limits vertical motion of the upper member 860 by interference.

The upper member 860 may comprise a top wall 843 to which is mounted a heating element 840. The heating element 840 may also be mounted to the side wall 870. A side wall 868 may be dimensioned and configured to fit closely to the side wall 864 of the lower member 862. The side walls may have dimensions and surfaces arranged such that friction between the outer surface 870 of the side wall 868 and the inner surface 872 of the side wall 864 will resist spontaneous or unintended movement therebetween, while still enabling manual force to reposition the upper member 860 and the lower member 864 as desired. Such adjustment, indicated by an arrow B in FIG. 9, varies proximity of the heating element 840 to for example tobacco 16 contained within the smoking chamber of a hookah to which the heater 836 has been mounted. The tobacco 16 is shown representatively, and may be supported in the position shown in FIG. 9 but not by the heater 836. For example, the tobacco 16 may be supported by the floor of a bowl, such as the bowl 34 of FIG. 1, of the hookah, or may be contained in a cage (not shown) supported by the bowl. Preferably, the heating element 840 is positioned at distance of between 0.25 to 0.5 inches above the tobacco. This distance provides for optimal heat transfer from the heating element 840 to the tobacco 16 while maintaining a standard 120V power supply.

Figure 10:
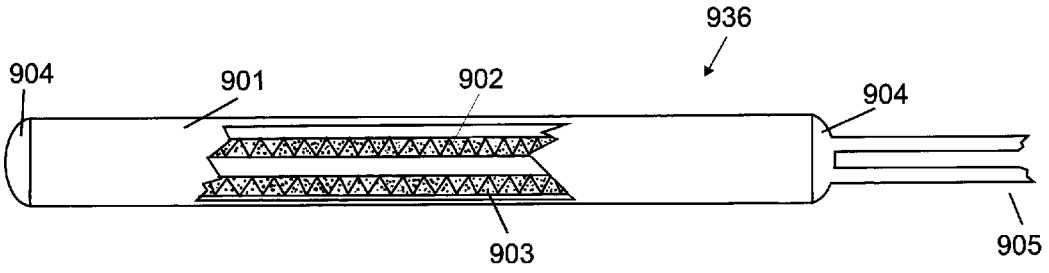
FIG. 10 is a side view of another heater which may be used with a hookah according to a further aspect of the invention, partially in section.

FIG. 10 shows a ceramic heater 936 which may be seen as a direct replacement for the combustible charcoal, which traditionally has been used in conventional hookahs. The ceramic heater 936 is preferable over metal heaters and may be contained in a partially open cage above or within the smoking chamber, similar to the smoking chamber 14 of FIG. 1. The ceramic heater 936 may be placed either directly on the tobacco or otherwise in heat exchange relation thereto. Preferably, the ceramic heater 936 is at a distance of between one quarter and one half inch above the smoking chamber top edge. This distance provides for the most efficient tobacco ignition while allowing for air flow into the housing during idle periods.

The ceramic heater 936 may be similar to the one manufactured by Hotwatt, Inc., and constructed in like fashion. The ceramic heater 936 may comprise a ceramic body 901, terminated at both ends by the ceramic end seals 904. The ceramic heater 936 may encase a resistance wire element 902, packed within a heating element 903, such as magnesium oxide, that effectively converts the electricity received through the wire element 902 into heat. Either end seal 904 of the ceramic heater 936 may be terminated with flexible insulated lead wires 905. The flexible insulated lead wires 905 may lead into a voltage adjuster, similar to the voltage adjuster shown in FIG. 3, and may ultimately terminate with a plug and cord assembly, such as the plug and cord assembly 252 of FIG. 3. Preferably, the ceramic heater 939 is mounted in the heater head 538 with a highly heat resistance ceramic holder (not shown) such as steatite that is of similar density and thermal conductivity as the ceramic heater 939. The holder prevents unwanted heat transfer to the heater head housing.

While the ceramic heater may utilize a simple plug and cord assembly to be plugged directly into a traditional 120 volt outlet, the voltage adjuster will provide means for a user to vary and control the heat output of the ceramic heater 936 at the user's impulse. The circuitry of the ceramic heater 936 and voltage adjuster may include any of the features of the circuitry described with respect to the previously presented drawings and figures and their respective subject matter. It should be appreciated that the ceramic heater 936 may be used in conjunction with the selectively variable damper arrangement, such as the arrangement shown in FIGS. 6 and 7.

The present invention is susceptible to modifications and variations which may be introduced thereto without departing from the inventive concepts. For example, although the invention has been described as obtaining electrical power using cord and plug assemblies such as the cord and plug assembly 252, it would be possible to provide electrical storage devices such as an electrochemical cell, a battery of such cells, a capacitor, a super capacitor, an electric double layer capacitor, or any combination of these devices.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

The invention claimed is:

1. An electric heater for a hookah smoking pipe having a smoking chamber for receiving a combustible substance and exposing the combustible substance to heat to generate smoke during an active smoking state, comprising:

an electrical heating element and an electric supply circuit disposed to conduct electrical power to the electrical heating element whereby the electrical heating element generates heat when electrical current flows through the electric supply circuit and no heat is generated when no current flows through the electric supply circuit;

a heater housing having an upper portion, a lower portion and a middle portion disposed between the upper and lower portions, the heater housing configured to house the electrical heating element, the heater housing having a plurality of holes configured to allow air to flow through the housing during active smoking of the hookah and for providing the directional flow of air from the upper portion to the lower portion, passing a stream of air over the electrical heating element during the active smoking state;

and a heater support member for maintaining the heater housing in a position relative to the smoking chamber whereby heat when generated by the heating element can impinge upon the combustible substance placed in the smoking chamber, wherein the lower portion of the heater housing has a diameter essentially between one quarter inch to one half inch larger that the smoking chamber and is configured to allow air to pass through the lower portion and through the plurality of sidewall holes during the idle state.

2. The electric heater of claim 1, wherein the heater housing is comprised of stainless steel, ceramic or glass.

3. The electric heater of claim 1, wherein the heater housing is comprised of a metal plated with gold.

4. The electric heater of claim 1, wherein the electric heating element is comprised of a ceramic resistive heater.

5. The electric heater of claim 1, wherein the heater housing is further comprises a connector associated with the electric supply circuit and configured to accept electrical connection from the electrical heating element.

6. The electric heater of claim 5, wherein the connector and the electrical heating element are both comprised of a ceramic material having essentially the same density and heat transfer property.

7. The electric heater of claim 1, wherein the heater support member is configurable to be positioned essentially within one half inch above the smoking chamber during the active smoking state.

8. The electric heater of claim 1, wherein the electric supply circuit is substantially disposed within the heater support member.

9. The electric heater of claim 1, wherein the heater support member is integral to the hookah pipe.

10. The electric heater of claim 8, wherein the heater support member is integral to the hookah pipe.

11. The electric heater of claim 1, wherein the electrical supply circuit further comprises a voltage adjuster.

12. The electric heater of claim 1, wherein the electrical supply circuit comprises a 12 volt circuit whereby electrical power may be obtained from a battery.

13. The electric heater of claim 11, wherein the voltage adjuster comprises a step down transformer located within the heater support member and having a plug and cord assembly extending from the heater support member and connected to the transformer, whereby electrical power at one hundred twenty volts may be obtained from an electrical receptacle, and electrical power at reduced voltage is supplied to the heating element.

14. The electric heater of claim 1, further comprising tilt sensor associated with the electrical supply circuit wherein the electrical supply circuit and disposed to stop electricity if tilt beyond a predetermined angle is detected.

15. An electric heater for a hookah smoking pipe having a smoking chamber for receiving a combustible substance and exposing the combustible substance to heat to generate smoke during an active smoking state, comprising:

an electrical heating element and an electric supply circuit disposed to conduct electrical power to the electrical heating element whereby the electrical heating element generates heat when electrical current flows through the electric supply circuit and no heat is generated when no current flows through the electric supply circuit;

a heater housing having an upper portion, a lower portion and a middle portion disposed between the upper and lower portions, the heater housing configured to house the electrical heating element, the heater housing having a plurality of holes configured to allow air to flow through the housing during active smoking of the hookah and for providing the directional flow of air from the upper portion to the lower portion, passing a stream of air over the electrical heating element during the active smoking state;

and a heater support member for maintaining the heater housing in a position relative to the smoking chamber whereby heat when generated by the heating element can impinge upon the combustible substance placed in the smoking chamber, wherein the heater housing is further composed of an adjustable damper arrangement disposed selectively to vary the area of the plurality of holes and to close the holes.

* * * * *